US006343872B1

(12) United States Patent
Cerone et al.

(10) Patent No.: US 6,343,872 B1
(45) Date of Patent: Feb. 5, 2002

(54) LIGHTING DEVICE FOR MOTOR-VEHICLES, HAVING A HIGHLY DISCONTINUOUS REFLECTIVE SURFACE

(75) Inventors: Roberto Cerone, Cirié ; Cataldo Esposito, Santena; Salvatore Pierro, Turin, all of (IT)

(73) Assignee: Automotive Lighting Italia S p A, Turin (IT)

( * ) Notice: Subject to any disclaimer, the term of this patent is extended or adjusted under 35 U.S.C. 154(b) by 0 days.

(21) Appl. No.: 09/598,912

(22) Filed: Jun. 22, 2000

(30) Foreign Application Priority Data

Oct. 15, 1999 (EP) ..... 99830649

(51) Int. Cl.[7] ..... F21V 7/00

(52) U.S. Cl. ..... 362/297; 362/517; 362/518; 362/346; 362/348; 362/540; 362/541; D26/118

(58) Field of Search ..... 362/297, 517, 362/518, 346, 348, 540, 541; D26/118

(56) References Cited

U.S. PATENT DOCUMENTS 4,308,573 A * 12/1981 McNamara, Jr. ..... 362/297
5,607,229 A * 3/1997 Rykowski et al. ..... 362/346
5,816,694 A * 10/1998 Ideker et al. ..... 362/346

* cited by examiner

*Primary Examiner*—Thomas M. Sember
*Assistant Examiner*—Ali Alavi
(74) *Attorney, Agent, or Firm*—Sughrue Mion, PLLC

(57) ABSTRACT

A lighting device for motor-vehicle comprises a reflective element having a plurality of projecting sectors which are equi-angularly spaced from each other, located around a light source arranged at the centre of the reflective element. The projecting sectors have reflective surfaces surrounding the light source which define a theoretical secondary reflective surface which is substantially different from the primary base surface from which the sectors project. The high discontinuity created in the surface of the reflective element by the presence of the projecting sectors gives rise to a unique aesthetical effect visible both in the condition of device on and in the condition of device off, the device is provided with a transparent element which is substantially clear, i.e. with no optical prisms.

11 Claims, 3 Drawing Sheets

LIGHTING DEVICE FOR MOTOR-VEHICLES, HAVING A HIGHLY DISCONTINUOUS REFLECTIVE SURFACE

BACKGROUND OF THE INVENTION

The present invention relates to a device for motor-vehicles, in particular a motor-vehicles light of the type comprising a hollow body including a reflective element, a light source located in front of the reflective element and a transparent element located in front of the light source and facing the reflective element.

SUMMARY OF THE INVENTION

The object of the invention is that of providing a lighting device of the above indicated type which is characterized by new and unique aesthetical features, both when the light is turned off and when the light is turned on, which features can be exploited to confer a unique aesthetical appearance to a motor-vehicle, while naturally insuring the requested lighting characteristics. The invention is particularly directed to motor-vehicle lights of any type, such as tail lights, turn indicator lights or stop lights, backup lights or fog tail lights.

According to the invention, the above-mentioned object is achived by providing a lighting device which is characterized in that:

- the transparent element has at least a substantial portion which has no optical prisms, so that the reflective element is visible from the outside, and in that
- the reflective element has a primary reflective base surface and a circumferential series of reflector sectors projecting from the primary base surface and located around the light source, said reflector sectors being angularly spaced from each other and all having inner reflective surfaces surrounding the light source and forming part of a single theoretical secondary reflective surface which is substantially different from said primary reflective surface, so as to create a high discontinuity between said reflector sectors and the portions of the primary reflective surface interposed therebetween,
- so that said reflective surfaces of the projecting sectors and said portions of the primary reflective surface interposed therebetween confer a petal-like aesthetical pattern to the reflective element, as seen from the outside through said prism-less transparent element.

In the device according to the invention, the reflective surfaces of the projecting sectors alternated to the portions of the primary base reflective surface which are interposed between the projecting sectors generate a unique aesthetical effect both when the device is turned on and when the device is turned off. When the device is turned on, the reflective surfaces of the projecting sectors define areas of greater light intensity, which are in contrast with the portions of the primary reflective base surface, which have a lower light intensity. When the device is turned off, the high discontinuity between the projecting sectors and the surface portions interposed therebetween gives rise anyway to the petal-like configuration which is markedly visible through the transparent element, which has no optical prisms. As the same time, relevant aesthetical differences are obtained between the device in the off condition and the device in the on condition.

In a preferred embodiment, each of said projecting sectors has two side surfaces which are radially oriented relative to the light source. Preferably, moreover, the above-mentioned radial side surfaces of each projecting sector are planar surfaces arranged radially relative to the light source simmetry axis, which defines the optical axis of the device. Also preferably, each projecting sector has, beside the above-mentioned inner reflective surface and the two radial side surfaces, also a radially outer surface. In this case, the outer surfaces of the various sectors preferably belong to a single theoretical surface having a tapered configuration towards the transparent element of the device.

As already indicated above, the above-mentioned projecting sectors originate a high discontinuity in the surface of the reflective element. In this regard, it can be considered that the above-mentioned sectors must project from the primary base surface by a distance at least greater than 5 millimetres.

BRIEF DESCRIPTION OF THE DRAWINGS

In an alternative embodiment, the reflective surface of each projecting sector has a stepped configuration at least for a portion thereof. Similarly, each portion of the primary base surface interposed between two projecting sectors has a surface with an undulated profile at least for a portion thereof. The above-mentioned undulated configuration and the above-mentioned stepped configuration of the reflective surfaces of the device can be optimized in order to assure the required lighting characteristics, while keeping the peculiar aesthetical features of the device, residing in the petal-like configuration.

Further features and advantages of the invention will become apparent from the description with reference to the annexed drawings, given purely by way of non limiting example, in which.

DETAILED DESCRIPTION

Figure 1:
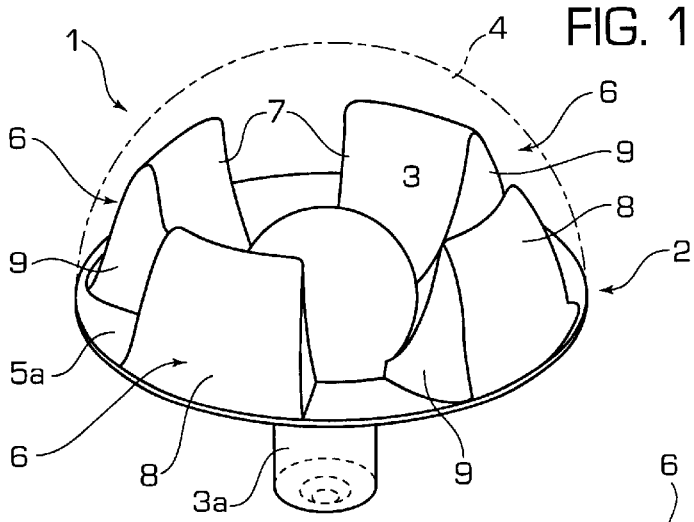
FIG. 1 is a perspective diagrammatic view of a first embodiment of a motor-vehicle light according to the present invention.
Figure 2:
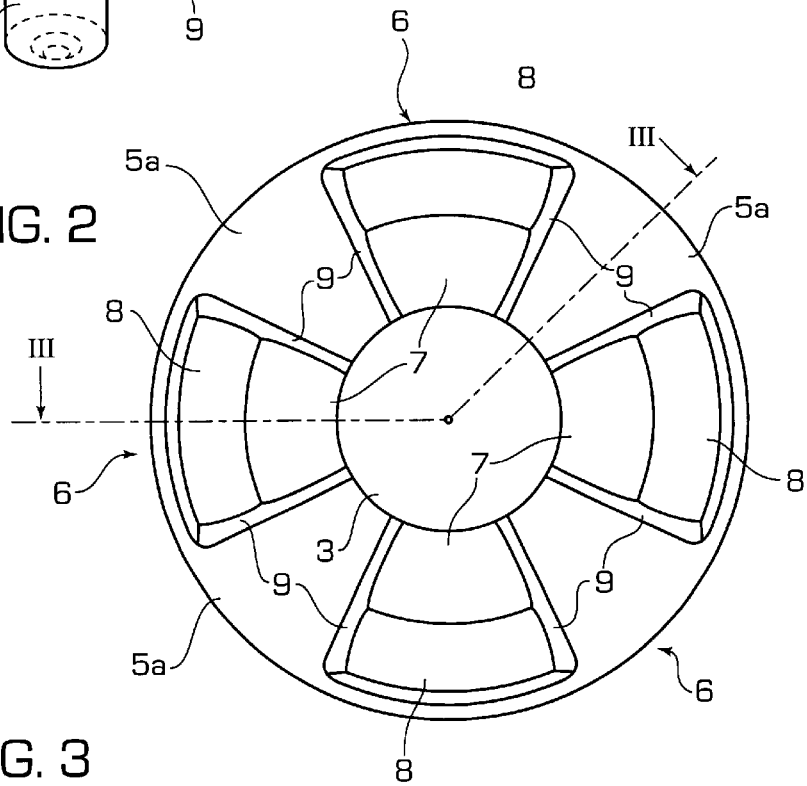
FIG. 2 is a front view of the light of FIG. 1.
Figure 3:
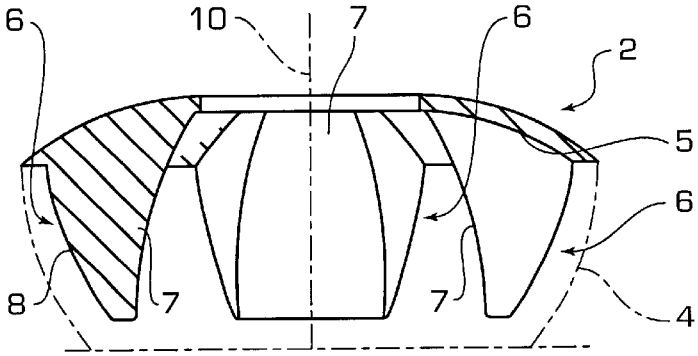
FIG. 3 is a sectional view taken along line III—III of FIG. 2.
Figure 4:
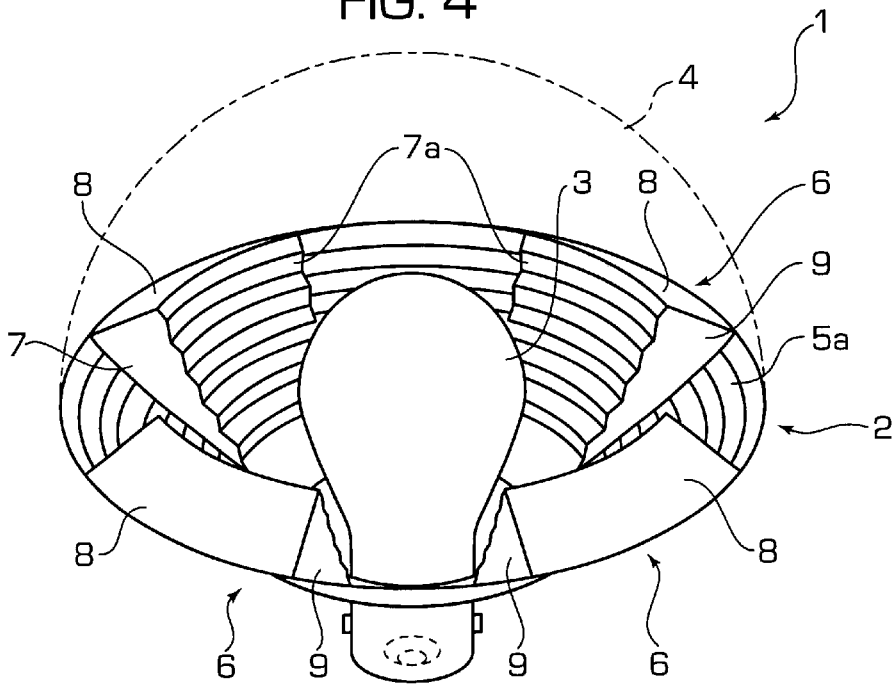
FIG. 4 shows a variant of FIG. 1.
Figure 5:
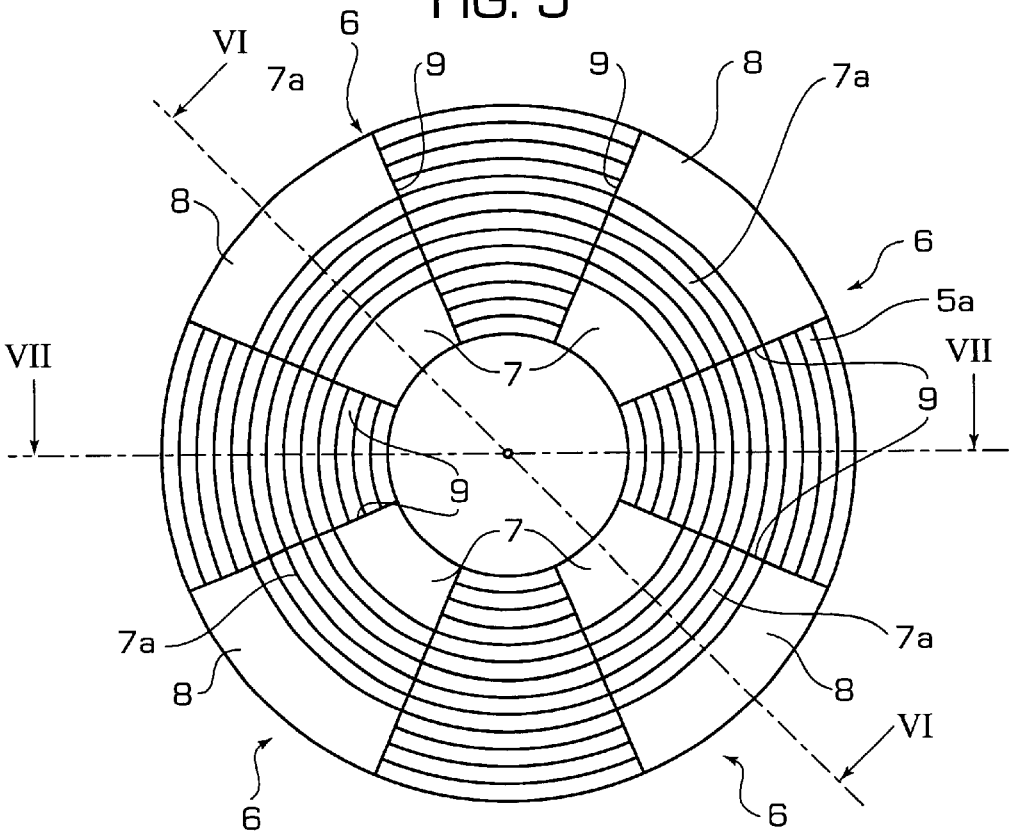
FIG. 5 is a front view of the light of FIG. 4, and FIGS. 6,7 are sectional views taken along lines VI and VII of FIG. 5.
Figure 6:
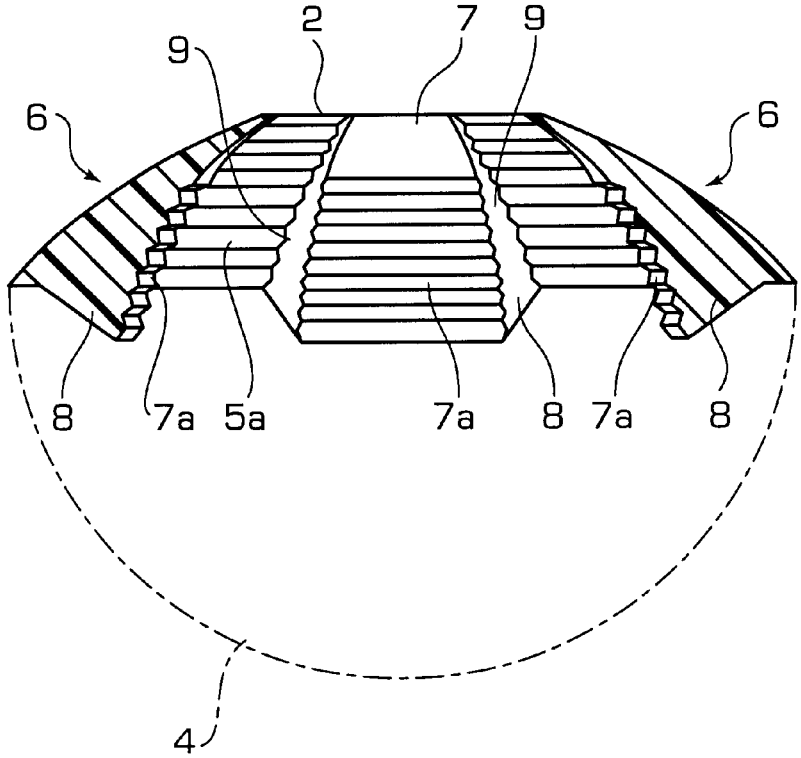
Figure 7:
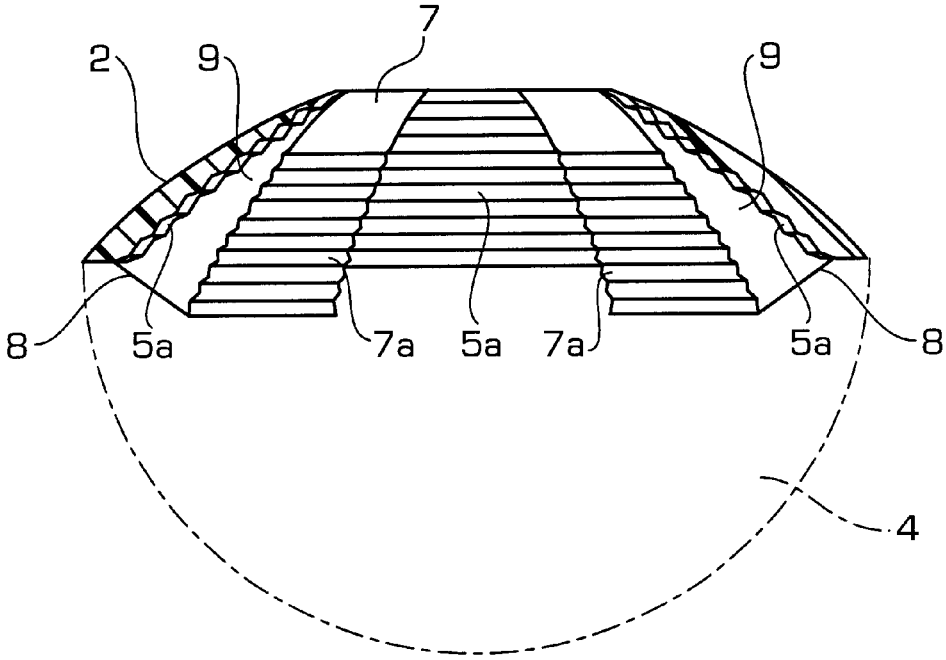

In FIGS. 1–3, there is shown a motor-vehicle light 1, such as a tail light, a turn indicator light, a stop light, etc. The light comprises a body including a reflective element generally designated by 2, in front of which the light source 3 is located (only visible in FIG. 1) constituted by an incandescence lamp. In the illustrated example, the lamp 3 has a stem 3*a* which is introduced through a central aperture of the reflective element 2. In front of the reflective element 2 there is located a transparent element 4, which in the illustrated example is constituted by a dome-like element of transparent plastic material, whose peripheral edge is connected to the peripheral edge of the reflective element 2. According to an important feature of the invention, the transparent element 4 is substantially clear, i.e. it has no optical prisms, at least for a substantial part thereof, so that the configuration of the reflective element 2 is clearly visible from the outside both when the light is off and when the light is turned on.

DETAILED DESCRIPTION OF THE INVENTION

As clearly visible in FIGS. 1–3, the reflective element 2 comprises a primary reflective base structure 5, such as in form of a paraboloid, or ellipsoid, or any other form, from which reflector sectors 6 project. The reflector sectors 6 are distributed and equi-angularly spaced, around lamp 3. Each projecting sector 6 has a reflective radially inner surface 7. The reflective surfaces 7 of the projecting sector 6 (which in the illustrated example are four in number) form part of a single secondary reflective surface, which is substantially different from the primary reflective surface 5. In the illustrated example, the secondary reflective surface is also a surface in form of a paraboloid or an ellipsoid or any other surface having an axis coincident with the axis of the primary base surface 5, but with a shape more closed around lamp 3, so as to constitute reflective surfaces 7 having a greater light intensity.

Also in the case of the illustrated example, the projecting sectors 6 also have radially outer surfaces 8 which all form part of a single theoretical surface tapering in the output direction of the light beam from light device. As also clearly shown in the drawings, each reflective sectors 6 also has two side surfaces 9 constituted by planar surfaces arranged radially relative to the optical axis 10.

As already described above, the sectors 6 project from the primary reflective base surface 5 by a substantial distance, at least greater than 5 mm. As a result of this, a high discontinuity is created between the reflective surfaces 7 of the sectors 6 and the portions of the primary surface 5, designated by 5*a*, interposed between sectors 6. This high discontinuity gives rise to a petal-like configuration (see FIG. 2) which is a feature of the light according to the invention and is clearly visible both in the condition of light off (because the transparent element 4 is substantially clear) and in the condition of light on (due to the relevant difference of light intensity between the reflective surfaces of sectors 6 and the portions 5*a* of the primary base Surface 5 which are interposed between sectors 6).

The embodiment shown in FIGS. 4–7 differs from that shown in FIGS. 1–3 only because it has a more "closed" configuration of the primary reflective base surface 5 and for that the reflective surfaces 7 of sectors 6 have portions 7*a* with a stepped configuration, while portions 5*a* of the primary reflective surface 5 have an undulated profile. This configuration is chosen to confer the required characteristics to the light beam coming out of the device, while keeping the aesthetical effects which have been described already above with reference to FIGS. 1–3.

Both the reflective element and the transparent element of the light according to the invention can be made of any material, such as of plastic material. Moreover, as clearly apparent from the foregoing description, the structure of the light according to the invention is particularly simple and inexpensive.

As clearly apparent from the annexed drawings, in the case of the illustrated example the projecting sectors 6 have an angular width similar to the angular width of the surface portions 5*a* interposed between the sectors 6.

Naturally, the principle of the invention remaining the same, the details of construction and the embodiments may widely vary with respect to what has been described and illustrated by way of example, without departing from the scope of the present invention.

In particular, the primary surface can be generated also by a number of different profiles, also not by a revolution of the profiles. Furthermore, the reflector sectors may also not be equi-angularly spaced.

What is claimed is:

1. Motor-vehicle lighting device comprising a body including a reflective element, a light source located in front of the reflective element and a transparent element located in front of the light source and facing the reflective element, wherein:

the transparent element has at least a substantial portion thereof which has no optical prisms, so that said reflective element is visible from the outside, and the reflective element has a primary reflective base surface and a circumferantial series of reflector sectors projecting from the primary base surface and arranged around the light source, said reflector sectors being angularly spaced from each other and all having inner reflective surfaces surrounding the light source and forming the part of a single theoretical secondary reflective surface which is substantially different from said primary reflective surface, so as to create a high discontinuity between said reflector sectors and the portions of the primary reflective surface interposed therebetween, so that said reflective surfaces of the projecting sectors and said portions of the primary reflective surface which are interposed therebetween confer a petal-like aesthetical pattern to the reflective element, as seen from the outside through the transparent element which has no prisms, wherein each projecting sector has two side surfaces which are radially oriented relative to the light source.

2. Lighting device according to claim 1, wherein said radial side surfaces of each projecting sector are planar surfaces arranged radially relative to the axis of symmetry of the light source, which defines the optical axis of the device.

3. Lighting device according to claim 2, wherein each projecting sectors has, beside said inner reflective surface and the two radial side surfaces, also a radially outer surface, the outer surfaces of the various sectors belonging to a single theoretical surface having a configuration tapering in the output direction of the light beam from the device.

4. Lighting device according to claim 1, wherein the reflective surface of each projecting sector has a stepped configuration at least on a portion thereof.

5. Lighting device according to claim 4, wherein each portion of the primary base surface interposed between two projecting sectors, has a surface with an undulated profile at least for a portion thereof.

6. Lighting device according to claim 1, wherein said projecting sectors project from the primary base surface by a distance greater than 5 mm.

7. Lighting device according to claim 1, wherein said primary base surface is generated by a revolution of a profile around an optical axis, with the light source located at the centre thereof, and said theoretical secondary surface defining the reflective surfaces of the projecting sectors is a revolution surface having an axis coincident with said optical axis.

8. Lighting device according to claim 7, wherein said theoretical secondary surface has a configuration which is closer around the light source with respect to the primary reflective base surface.

9. Lighting device according to claim 1, wherein said transparent element has a dome-like configuration with a base peripheral edge adjacent to the peripheral edge of said reflective element.

10. Lighting device according to claim 1, wherein said projecting sectors have an angular width substantially similar to the angular width of the portions of the base surface which are interposed between the sectors.

11. Lighting device according to claim 10, wherein said projecting sectors are four in number.

* * * * *